United States Patent [19]

Morita et al.

[11] 4,450,829

[45] May 29, 1984

[54] WATER SAVING SYSTEM

[76] Inventors: Deen I. Morita; Mark K. Morita, both of 1658 Auiki St., Honolulu, Hi. 96819

[21] Appl. No.: 426,272

[22] Filed: Sep. 29, 1982

[51] Int. Cl.[3] ..... F24H 1/00

[52] U.S. Cl. ..... 126/362; 237/19

[58] Field of Search ..... 126/361, 362; 237/19; 122/406 R, 13 R; 219/296; 137/334, 340

[56] References Cited

U.S. PATENT DOCUMENTS

| | | | |
|---|---|---|---|
| 2,399,985 | 5/1946 | Chandler | 126/362 X |
| 3,705,574 | 12/1972 | Duncan | 126/362 |
| 4,141,222 | 2/1979 | Ritchie | 126/362 X |
| 4,321,943 | 3/1982 | Hans | 126/362 X |

*Primary Examiner*—Edward G. Favors

*Attorney, Agent, or Firm*—Robert E. Burns; Emmanuel J. Lobato; Bruce L. Adams

[57] ABSTRACT

A hot water distribution system for a dwelling or other building is designed to avoid the waste of water incident to letting the water run until hot water reaches an open hot water faucet or valve. Adjacent each hot water outlet valve there is a control unit having an inlet connected to a hot water supply line from the water heater, a supply outlet connected to the hot water faucet or valve and a return outlet connected by a return line to an inlet of the water heater. Between the inlet and the supply outlet of the control unit there is a normally closed valve which is thermostatically controlled so as to open only when water in the control unit is at or above a predetermined temperature. When a hot water faucet or valve is opened and water in the hot water supply line has cooled to a temperature below a predetermined value, the control valve remains closed and water in the hot water supply line is returned to the water heater by a circulating pump. When hot water reaches the control unit, the control valve is thermostatically opened so as to supply a full flow of hot water to the faucet or outlet valve. The water circulating pump is then turned off, thereby avoiding a waste of energy that would be incident to continuous operation of the pump.

10 Claims, 2 Drawing Figures

WATER SAVING SYSTEM

FIELD OF INVENTION

The present invention relates to water distribution systems in homes and other buildings and is designed to avoid the waste of water.

BACKGROUND OF THE INVENTION

In a water distribution system of a building, a water heater operating for example with electricity, gas or oil is customarily located in the basement or on the ground floor near the entry of the water supply to the building. The hot water provided by the heater is distributed to various locations of use in the building. For example a hot water faucet is provide over the kitchen sink. In one or more bathrooms, which may for example be on the second floor of the building, hot water may be supplied to a lavatory, a bathtub and a shower. These points of use are connected by suitable piping with the water heater.

The piping connecting the water heater with the points of use, is usually not insulated. However, even if it is insulated, water in the connecting piping becomes cold, i.e. room temperature, after a period of time. Hence, when hot water is desired at a point of use, it is necessary to let the water run for a considerable period of time in order for the cold water in the piping to be expelled. This water is ordinarily allowed to run down the drain and is hence wasted.

In many areas there is a water shortage, particularly in certain seasons of the year. At such times, the use of water is restricted. It is hence highly undesirable for water to be wasted in the manner described above. Moreover, since water in many areas is metered, the waste of water entails unnecessary expense.

It has been proposed to provided "instant" hot water at points of use by continually circulating water in the hot water system. While this avoids the waste of water in the manner described above, it results in a waste of energy not only by reason of the power consumed by a continuously operating circulating pump, but also by the continual reheating of water which has cooled during its circulation through the system.

SUMMARY OF THE INVENTION

It is an object of the present invention to provide a hot water distribution system which not only avoids the waste the water but also avoids the waste of energy. In accordance with the invention, a control unit is provided adjacent each hot water faucet or other hot water outlet valve. The control unit has an inlet connected by a hot water supply line with the water heater, a supply outlet connected with the respective hot water outlet valve and a return outlet connected by a return line with an inlet of the water heater. The hot water supply line and return line in conjunction with the water heater and the control unit form a closed circuit through which water can be circulated.

The control unit has a normally closed control valve between the water inlet of the control unit and the outlet connected with the outlet valve. If the outlet valve, for example a faucet, is opened when water in the hot water supply pipe is cold, the control valve in the control unit remains closed. However, the opening of the outlet valve initiates the operation of a circulating pump in the return line so that cold water in the hot water supply line is returned to the water heater instead of being wasted. When hot water reaches the control unit, the control valve is opened by a temperature responsive control so as to permit flow of water through the control valve and the outlet valve. When this has ocurred, the water circulating pump is turned off, thereby avoiding the waste of energy through continuous circulation. The system in accordance with the present invention thus avoids waste of water and and also the waste of energy.

BRIEF DESCRIPTION OF DRAWINGS

The nature objects and advantages of a water saving system in accordance with the present invention will be more fully understood from the following description of a preferred embodiment illustrated by way of example in the accompanying drawings in which.

DESCRIPTION OF PREFERRED EMBODIMENT

Figures 1, 2:
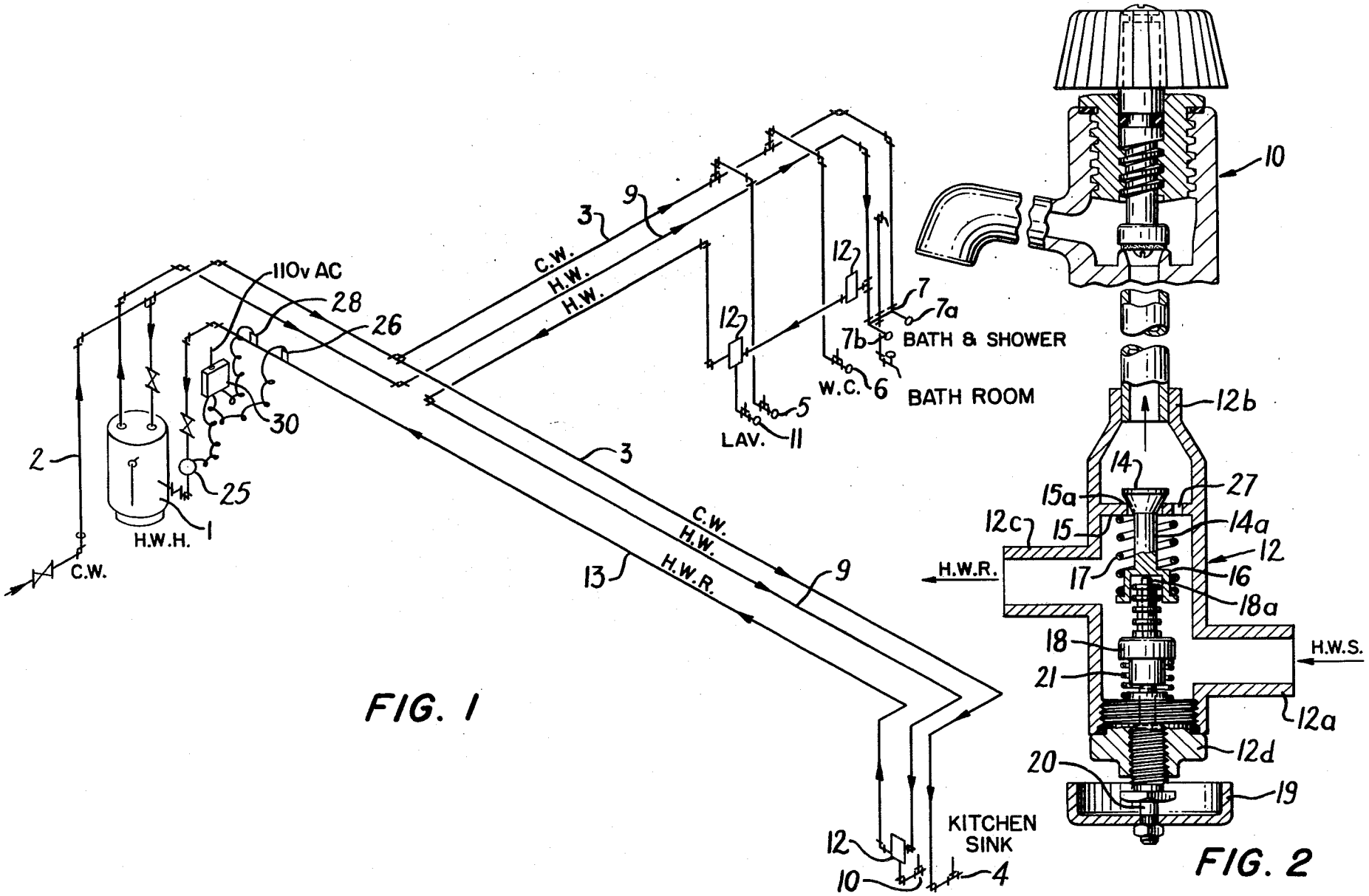
FIG. 1 is a schematic view of a water distribution system in accordance with the present invention and FIG. 2 is a schematic sectional view showing a water faucet or other outlet valve and associate control unit.

In FIG. 1, there is shown by way of example a water distribution system suitable for example for a small home or apartment. The system includes a water heater 1 which may, for example use electricity, gas, or oil as the heating medium. Water is supplied to the heater by a cold water supply line 2 through which cold water is also supplied through a line 3 to a cold water faucet 4 at a sink in the kitchen area, a cold water faucet 5 at a lavatory in the bathroom area, a water closet 6 and a bath and shower fitting 7 having a cold water valve **7*a* and a hot water valve 7*b*. From the water heater 1, hot water is supplied through a hot water supply line 9 to a hot water faucet 10 at the kitchen sink, a hot water faucet 11 at the lavatory in the bathroom and valve 7*b* of the bath and shower fitting 7**.

In accordance with the present invention, a control unit 12 is provided adjacent each of the hot water faucets or outlet valves. As illustrated by way of example in FIG. 2, the control unit 12 comprises a casing having an inlet **12*a* connected with the hot water water supply line 9, a supply outlet 12*b* connected with the respective hot water outlet valve (shown by way of example in FIG. 2 as the hot water faucet 10) and a return outlet 12*c* connected by a return line 13 with an inlet of the water heater 1. The lower end of the casing of the control unit 12 is closed by a threaded cap 12*d*** screwed into the threaded lower end of the casing.

Between the inlet **12*a* and the supply outlet 12*b* of the control unit 12 there is provided a normally closed valve illustrated by way of example as a tapered valve member 14 adapted to seat on a valve seat 15*a* provided in a partition 15 in the control unit casing. The valve member 14 has a stem portion 14*a* secured to a cup-shaped fitting 16 which provides a seat for a coil compression spring 17 acting between the fitting 16 and the partition 15 to hold the valve 14** normally in closed position.

In accordance with the invention, means is provided for opening the valve 14 when water in the control unit is at or above a predetermined temperature. Such temperature responsive means is illustrated by way of example in FIG. 2 as comprising a thermostat 18 which acts on the valve member 14 through a push rod **18*a* to move it upwardly against the bias of the spring 17 when a predetermined water temperature is reached. The thermostat act between the member 16 on the valve stem 14***a* and an adjustable screw 20 which tends through the cap 12*d* and is rotatable by a head 19 to set the temperature at which the valve 14 is opened. The spring 17 is partially counter-balanced by a lighter spring 21 acting between the thermostat 18 and the cap 12*d*.

In the return line 13, there is provided, adjacent the water heater 1, a circulator 25 for circulating water in the closed circuit comprising the hot water supply line 9 and the return line 13 together with the water heater and control units. The circulator may for example be an electrically operated pump. When in operation, the pump draws water from the return line 13 and thereby causes hot water from the heater to flow out through the hot water supply line 9 to the several hot water outlets. In accordance with the present invention, means is provided for energizing the pump 25 to circulate water in the afore mentioned closed circuit whenever one of the hot water outlet valves is opened and the control valve 14 of the respective control unit 12 is closed by reason of water in the control unit being at a temperature below the predetermined temperature as set by adjustment of the thermostat 18. Hence in these conditions, cold water in the hot water supply line 9 is returned to the water heater through the return line 13 instead of being wasted by being discharged through the open hot water outlet valve and allowed to run down the drain.

As illustrated by way of example in the drawings, operation of the circulator 25 is initiated by a pressure responsive switch 26 in the return line 13, for example in the vicinity of the circulator. In the partition 15 of the control unit 12, there is provided a small aperture 27 which bypasses the normally closed valve 14. When the hot water outlet valve shown in FIG. 2 as faucet 10 is opened, a small amount of water flows through the orifice 27 and this results in lowering the pressure in the return line 13 so that the pressure responsive switch 26 starts the circulating pump. Although a small amount of water flows through the orifice 17, the amount of water thereby lost is quite small. By operation of the circulating pump 25, cold water in the hot water supply line 9 and the return line 13 is returned to the water heater 1 for reheating and hot water is supplied from the water heater 1 through the hot water supply line 9. When the hot water reaches the respective control unit, the thermostat 18 opens the valve 14 and thereby supplies a full flow of hot water to the respective outlet valve or faucet.

In accordance with the invention, means is provided for turning off the circulating pump when hot water has been supplied to the outlet valve, thereby avoiding the waste of energy that would result from continuous operation of the circulating pump. As illustrated by way of example in the drawings, the circulating pump is turned off by means of a thermostatic switch 28 in the return line 13. In the illustrated embodiment, the thermostatic switch 28 is located in the vicinity of the circulator 25 and the water heater 1. When cold water in the circuit comprising the hot water supply line 9 and return line 13 has been replaced by hot water, the thermostatic switch 28 is actuated to turn off the circulating pump 25. The pump then remains off until it is again turned on in the manner described above when hot water is desired at one or another of the hot water outlets. The pressure responsive switch 26 and thermostatic switch 28 are preferably adjustable to permit setting the pressure and temperature respectively at which they operate. The thermostatic switch 28 is preferably set to operate at a higher temperature than the thermostat 18 in the control unit 12. As these switches may be of conventional design, they are shown only schematically. The pressure responsive switch 26 and thermostatic switch 28 are connected with the circulator pump 25 through a controller 30 comprising for example suitable relay means. When the pump is turned off by the thermostatic switch 28, the controller 30 is reset to prepare it for operation when there is again a demand for hot water.

It will be noted that the hot water outlets are connected in series so that all are in a single closed circuit. There hence need be only a single circulating pump which is controllable in the manner described above by operation of any of any of the hot water supply valves or faucets. It will be understood that in accordance with plumbing practice, suitable shut-off valves can be provided as illustrated by way of example in FIG. 1 in order to shut down the system, for example for maintenance. A check valve 31 is provided in the return line 13.

While a preferred embodiment of the invention has been illustrated by way of example in the drawings and is herein particularly described, it will be understood that modifications can be made. The invention is hence in no way limited to the illustrated embodiment.

What we claim is:

1. A water saving system comprising a water heater having a supply inlet connected with a water supply, a hot water supply outlet and a return inlet, an outlet valve at a location where hot water is to be used, a control unit adjacent said outlet valve and having an inlet, a supply outlet connected with said outlet, a return outlet and a normally closed control valve between said inlet and said supply outlet, a first line connecting the supply outlet of said heater with the inlet of said control unit, a second line connecting the return outlet of said control unit with the return inlet of said heater, said first and second lines together with said heaters and control unit forming a closed circuit, energizable means for circulating water in said circuit to return water from said control unit to said heater, means for energizing said circulating means when said outlet valve is opened and the temperature of water in said control unit is below a predetermined value, to circulate water in said circuit and thereby bring hot water from said heater to said control unit, means for opening said control valve when the temperature of water in said control unit reaches a predetermined value to supply hot water to said outlet valve and means for deenergizing said circulating means when the temperature of water in said circuit reaches a predetermined value.

2. A water saving system according to claim 1, in which said control unit includes a small orifice by—passing said control valve, whereby a flow of a small amount of water flowing through said orifice when said outlet valve is opened causes a drop in pressure in said circuit, said means for energizing said circulating means comprising a pressure sensitive switch in said circuit.

3. A water saving system according to claim 2, in which said pressure sensitive switch is located in said second line in the vicinity of said circulating means.

4. A water saving system according to claim 1, claim 2 or claim 3 in which said circulating means comprises a pump in said second line in the vicinity of said heater.

5. A water saving system according to claim 1 or claim 2, in which said means for deenergizing said circulating means comprises a thermostatically controlled switch.

6. A water saving system according to claim 5, in which said theromostatically controlled switch is responsive to the temperature of water in said second line.

7. A water saving system according to claim 6, in which said thermostatically controlled switch is located in the vicinity of said heater.

8. A water saving system according to claim 5, in which said thermostatically controlled switch is actuatable to deenergizing said circulating means at a temperature higher than that at which said control valve is opened.

9. A water saving system according to claim 1, in which said means for opening said control valve comprises a thermostat responsive to the temperature of water in said control unit.

10. A water saving system according to claim 9, in which means is provided for variably setting the temperature at which said thermostat opens said control valve.

* * * * *